United States Patent [19]

Chetelat

[11] 4,040,245

[45] Aug. 9, 1977

[54] ELECTRONIC WATCH

[75] Inventor: Fernand Chetelat, Cortaillod, Switzerland

[73] Assignee: Ebauches S.A., Neuchatel, Switzerland

[21] Appl. No.: 672,971

[22] Filed: Apr. 2, 1976

[30] Foreign Application Priority Data

Apr. 25, 1975 Switzerland ..... 5362/75

[51] Int. Cl.[2] ..... G04B 19/00; G04B 19/24

[52] U.S. Cl. ..... 58/4 A; 58/58

[58] Field of Search ..... 35/35 RC, 39; 40/107; 58/4 A, 50 R, 58; 350/324 R, 324 M, 336

[56] References Cited

U.S. PATENT DOCUMENTS

| | | | |
|---|---|---|---|
| 3,789,600 | 2/1974 | Champan | 58/39.5 |
| 3,925,977 | 12/1975 | Maezawa | 58/4 A |
| 3,945,190 | 3/1976 | Kimura | 58/4 A |

*Primary Examiner*—E. S. Jackmon

*Attorney, Agent, or Firm*—Imirie, Smiley & Linn

[57] ABSTRACT

An electronic watch having an alpha-numeric display for displaying the time in seconds, minutes and hours and the date and day of the week. The date and day of the week is displayed in an abbreviated form and the language used for the display can be optionally selected without modification of the circuit by appropriate connection of a control terminal.

5 Claims, 5 Drawing Figures

ELECTRONIC WATCH

BACKGROUND OF THE INVENTION

The invention concerns an electronic watch having an alpha-numeric display comprising, in addition to the counter-dividers adapted to indicate seconds, minutes, hours and the date, at least one counter adapted to provide a display in the form of letters of the alphabet.

There are known watches having an alpha-numeric display which provide not only the time, i.e. hours, minutes, seconds and the date, but also in abbreviated form the days and the months. To provide the possibility of displaying not only numbers but also letters, nine segment digits have been chosen. The term "digit" can be defined as being an assembly of members called "segments,"which can be, in an independent manner, rendered luminous or the colour of which can be changed, the geometrical disposition of these segments permitting the representation of the numbers from 0 to 9 and all or some of the letters of the alphabet.

However, in known watches, the display of the name of the days and the months is effected in single predetermined language and for each linguistic region to which the watch is destined to be used, the manufacture is obliged to provide an additional circuit to modify the watch to the language of the region.

The invention proposes to provide a watch in which by a simple operation on the circuit of the watch, the manufacturer, or even the user, can choose the language in which he wants the days and the months to be displayed.

SUMMARY OF THE INVENTION

According to the invention there is provided an electronic watch having an alpha-numeric display comprising, in addition to counter-dividers adapted to indicate seconds, minutes, hours and date, at least one counter adapted to provide a display in the form of letters of the alphabet, and several encoding means associated with the said at least one counter, each of the encoding means being adapted to a particular language and being selectively actuatable by means of a control terminal.

BRIEF DESCRIPTION OF THE DRAWINGS

The present invention will be described further, by way of example, with reference to the accompanying drawings, in which.

DETAILED DESCRIPTION

Figures 1, 2:
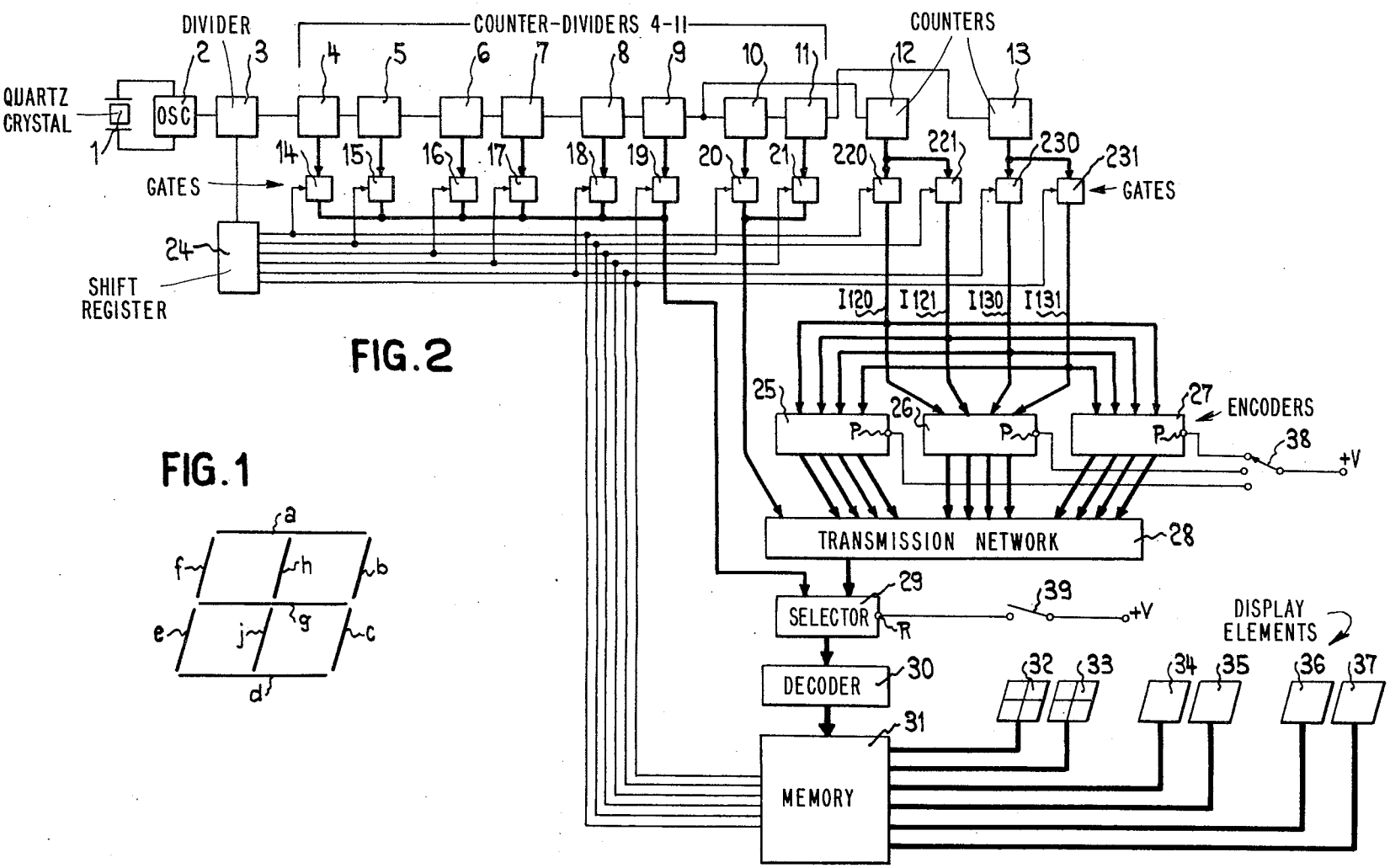
FIG. 1 shows a nine segment digit for an alpha-numeric display.
FIG. 2 shows a block diagram of one embodiment of a watch in accordance with the invention.

In FIG. 2, there is shown the circuit of a watch with a six digit display, the digits 32 to 37 are grouped in pairs and can, consequently, simultaneously give three sets of information each occupying two digits. The watch comprises a circuit 2 which, with its quartz crystal 1, forms an oscillator. The output of circuit 2 is supplied to a divider 3, the ouput of which is used to control a group of conventional counter-dividers 4 to 11 each of which gives one item of information (heavy lines) the nature of which will be listed hereunder:

| | | |
|---|---|---|
| counter-divider | 4: | units of seconds |
| counter-divider | 5: | tens of seconds |
| counter-divider | 6: | units of minutes |
| counter-divider | 7: | tens of minutes |
| counter-divider | 8: | units of hours |
| counter-divider | 9: | tens of hours |
| counter-divider | 10: | units of days |
| counter-divider | 11: | tens of days |

A counter 12 is also provided which receives one impulse per day from the counter-divider 9 (tens of hours) and a counter 13 is provided which receives one impulse per month from the counter-divider 11 (tens of days). The lines of the bits containing the information of the counter-dividers 4 to 9 (heavy lines) pass through transmission gates 14 to 19 before being connected via a common line to a selector for groups of information 29. A shift register 24 driven by a train of impulses from divider 3 successively enables, via its six outputs the transmission gates 14 to 19. Simultaneously, the six outputs of the register 24 successively operate six further transmission gates 20, 21, 220, 221, 230 and 231. The outputs of the counter-dividers 10 and 11 are connected to gates 20 and 21, the outputs of which are connected together and connected to a transmission device 28. The output of the counter 12, is supplied to two gates 220 and 221. Similarly, the output of the counter 13 is supplied to the gates 230 and 231. The four sets of information I120, I121, I130 and I131 are thus provided as identical pairs but are transmitted one after the other due to action of the register 24. The sets of information are fed in parallel to three encoders 25, 26, and 27, each having a control input P from a selector switch 38 by means of which each encoder may be selectively connected to a potential +V corresponding to a logical potential "1". The outputs of the encoders are connected to the transmission device 28, the output of which forms a second input of the information selector 29. This selector 29 allows the passage to its outlet of one of the two groups of information which are presented at its inputs if on its control input R a potential +V is supplied by closure of a switch 39. The selected group of information is then supplied by a decoder 30 which outputs the decoded information to a memory 31. As will be seen later, this memory comprises a set of memories for each digit 32 to 37 of the display. Each set is controlled by an impulse of the register 24. The information provided by the device 31, drive the digit display. Each encoder 25, 26 and 27, corresponds to a particular language and the user or the manufacturer could, with the assistance of the selector 38, choose that which is convenient to him.

Figure 3:
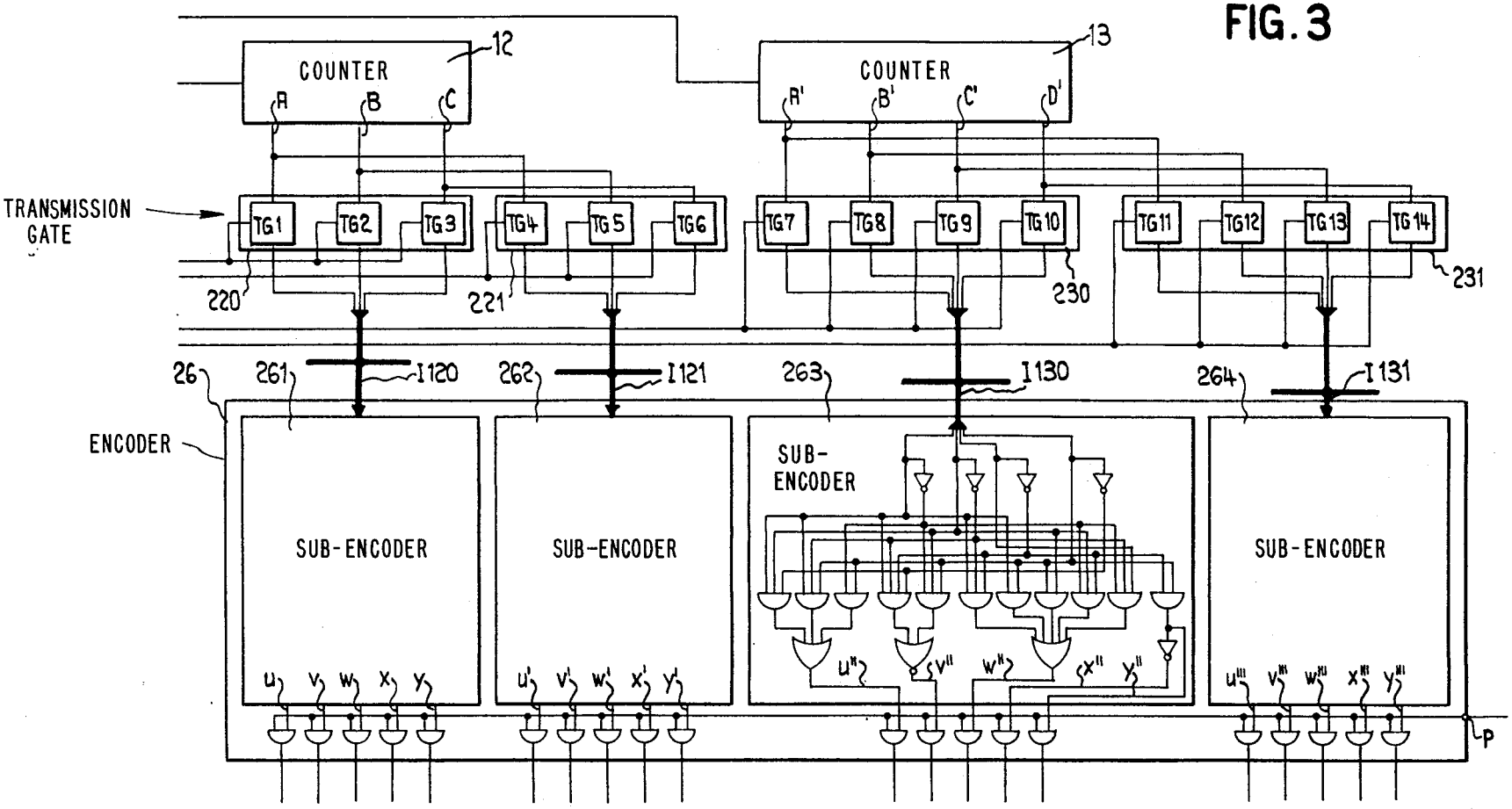
FIGS. 3 to 5 illustrate different details of the block diagram of FIG. 2.

The diagram of FIG. 3 shows a first detail of the watch in accordance with the invention. The output of counter 12 which is for controlling the display of the day comprises three output lines (corresponding to three bits) A, B, C, since the week comprises seven days, and three bits suffice to identify them all. The counter 13, for controlling the display of the months, has four output lines A', B', C'and D'. Each output line of the counters 12 and 13 is fed in parallel to two transmission gates TG1, TG4 for A; TG2, TG5 for B: TG3,, TG6 for C; and TG7, TG11 for A'; TG8, TG12 for B'; TG9, TG13 for C'; TG10, TG14 for D'. The encoder 26 of FIG. 2 is shown in greater detail in FIG. 3. The sets of information I120, I121, I131 from gates 220, 221, 230 and 231 are each supplied to a sub-encoder 261, 262, 263 and 264 which transforms their three or four bit information into a five bit code. Each output of the encoders 261 to 264 is connected to an AND gate controlled by the control input P. The principal of encoding effected by the sub-encoders of which only one (263) has been illustrated in detail will now be described further. In table I, each letter required corresponds to a number which can be expressed by a binary number of five bits, the ten first order numbers (0–9) having been reserved for the figures of 0 to 9 for the numeric display.

TABLE I

| | | y x w v z (bits) |
|---|---|---|
| 10. | J | 0 1 0 1 0 |
| 11. | A | 0 1 0 1 1 |
| 12. | F | 0 1 1 0 0 |
| 13. | E | 0 1 1 0 1 |
| 14. | M | 0 1 1 1 0 |
| 15. | P | 0 1 1 1 1 |
| 16. | Y | 1 0 0 0 0 |
| 17. | U | 1 0 0 0 1 |
| 18. | L | 1 0 0 1 0 |
| 19. | S | 1 0 0 1 1 |
| 20. | C | 1 0 1 0 0 |
| 21. | N | 1 0 1 0 1 |
| 22. | D | 1 0 1 1 0 |
| 23. | O | 1 0 1 1 1 |
| 24. | T | 1 1 0 0 0 |
| 25. | W | 1 1 0 0 1 |
| 26. | H | 1 1 0 1 0 |
| 27. | R | 1 1 0 1 1 |

The binary numbers on the right hand side of the table I are thus those which will appear on the outputs of the sub-encoders to be applied to the decoder 30 (FIG. 2).

For an English transcoder with the abbreviations comprising two letters, two sub-encoders 261, 262 and 263, 264 are required for encoding the information given by the counters 12 and 13, respectively. In table II below, the outputs A, B, C of the counter 12 are shown with the abbreviation of the day which correspond to the state of the outputs A, B and C and the state of the outputs u, v, w, x, y; u', v', w', x', y' of the corresponding sub-encoders 261 and 262.

It is from there relatively easy to determine the required logic function and contraction of sub-encoders 261, 262, 263 and 264. The formulas, in Boolean algebra, are shown in table IV for performing the required functions.

TABLE IV

| Sub-encoder 261 (1st digit of the day) | Sub-encoder 262 (2nd digit of the day) | Sub-encoder 263 (illustrated) (1st digit of the month) |
|---|---|---|
| $u = \overline{AB} + AC$ | $\overline{u}' = A\overline{BC}$ | $\overline{u}'' = A'\overline{B'D'} + A'\overline{B'}C' + \overline{A'}D$ |
| $v = \overline{ABC} + AC + BC$ | $\overline{v}' = \overline{AB} + A\overline{BC}$ | $\overline{v}'' = A'\overline{B'C'D'} + \overline{A'}B'\overline{C'D'}$ |
| $w = \overline{AB}$ | $w' = \overline{AC}$ | $\overline{w}'' = A'\overline{B'C'} + A'D' + A'B'$ |
| | | $\overline{A'B'C'} + \overline{A'B'}\,C$ |
| $x = \overline{BC} + AC$ | $\overline{x}' = \overline{BC} + BC$ | $\overline{x}'' = \overline{C'D'}$ |
| $y = \overline{AB}$ | $\overline{y}' = \overline{ABC} + AC$ | $\overline{y}'' = \overline{C'D'}$ |

| Sub-encoder 264 (2nd digit of the month) |
|---|
| $\overline{u}''' = \overline{A'C} + A'\overline{B'D'}$ |
| $\overline{v}''' = \overline{A'C'D'} + B'\overline{C'D'} + \overline{A'B'}$ |
| $\overline{w}''' = \overline{D'} + A'\overline{C'}$ |
| $\overline{x}''' = \overline{AB} + \overline{A'C'D'} + ABD$ |
| $\overline{y}''' = C' + \overline{A'B'D'} + A'\overline{B'D'}$ |

Figure 4:
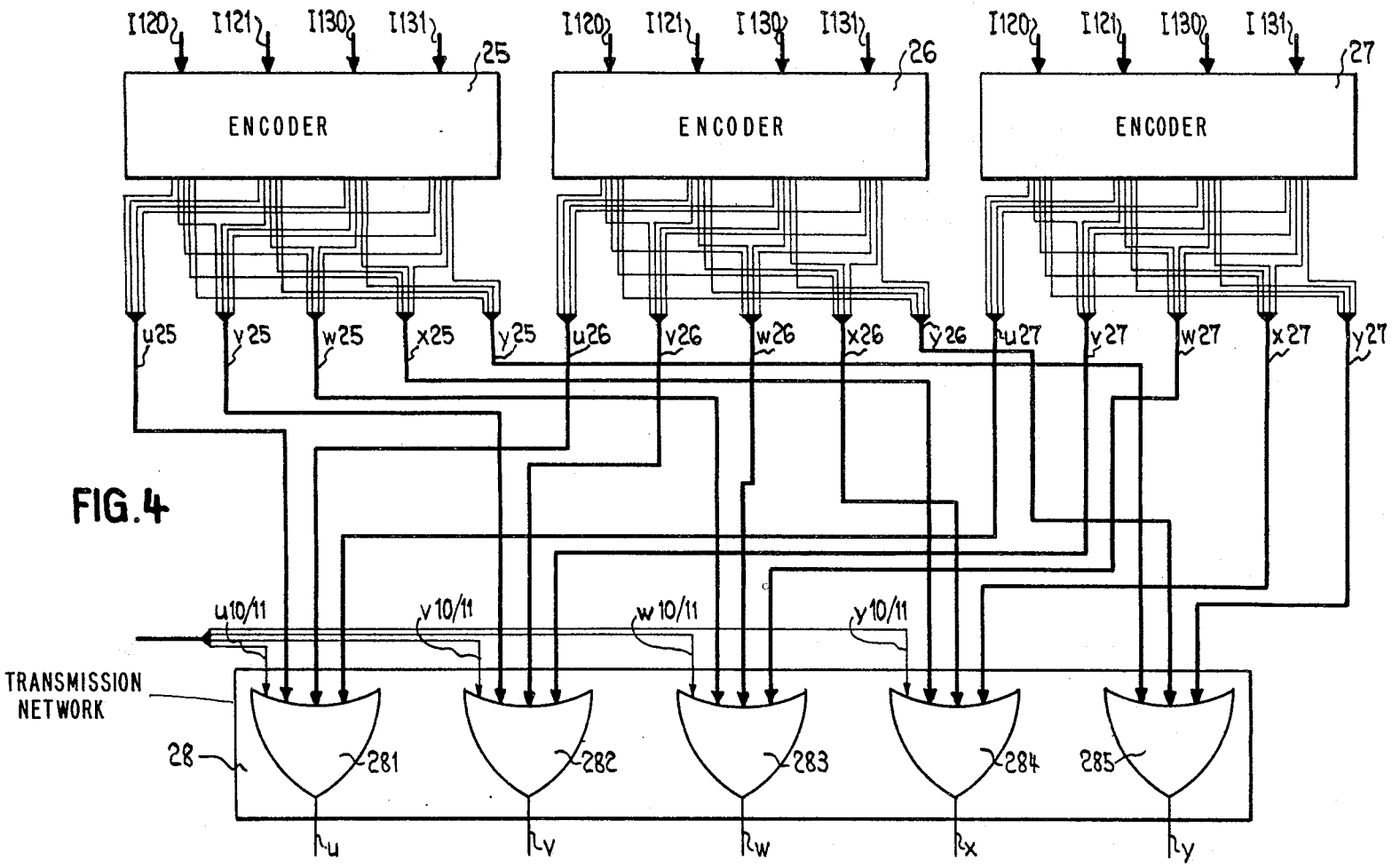

In FIG. 4, there is illustrated the transmission device 28 with its connections from outputs of the encoders 26, 26 and 27. The transmission device 28 is composed of five OR gates 281, 282, 283, 284 and 285. Each OR gate receives inputs which represent binary digits of the same significance not to be confused with the display "digits") which includes the information of the counter-dividers 10 and 11 and of the different sub-encoders of the encoders 25, 26 and 27, namely: *u* 25, *u* 26, *u* 27, *u* 10/11 for the gate 281, *v* 25, *v* 26, *v* 27, *v* 10/11 for the gate 282, etc. . . . It is to be noted that the informations of the counters 10 and 11 only comprise four bits: *u* 10/11, *v* 10/11, *w* 10/11 and *x* 10/11. To simplify the drawing, the outputs of the transmission device 28 have the same reference letters *u, v, w, x, y* as the outputs of the sub-encoder 261, although these outputs successively carry the information of the counter-divider 10, the counter-divider 11, the counter-divider 11, the information I120 encoded, then I121 encoded I130 encoded, and finally I131 encoded.

Figure 5:
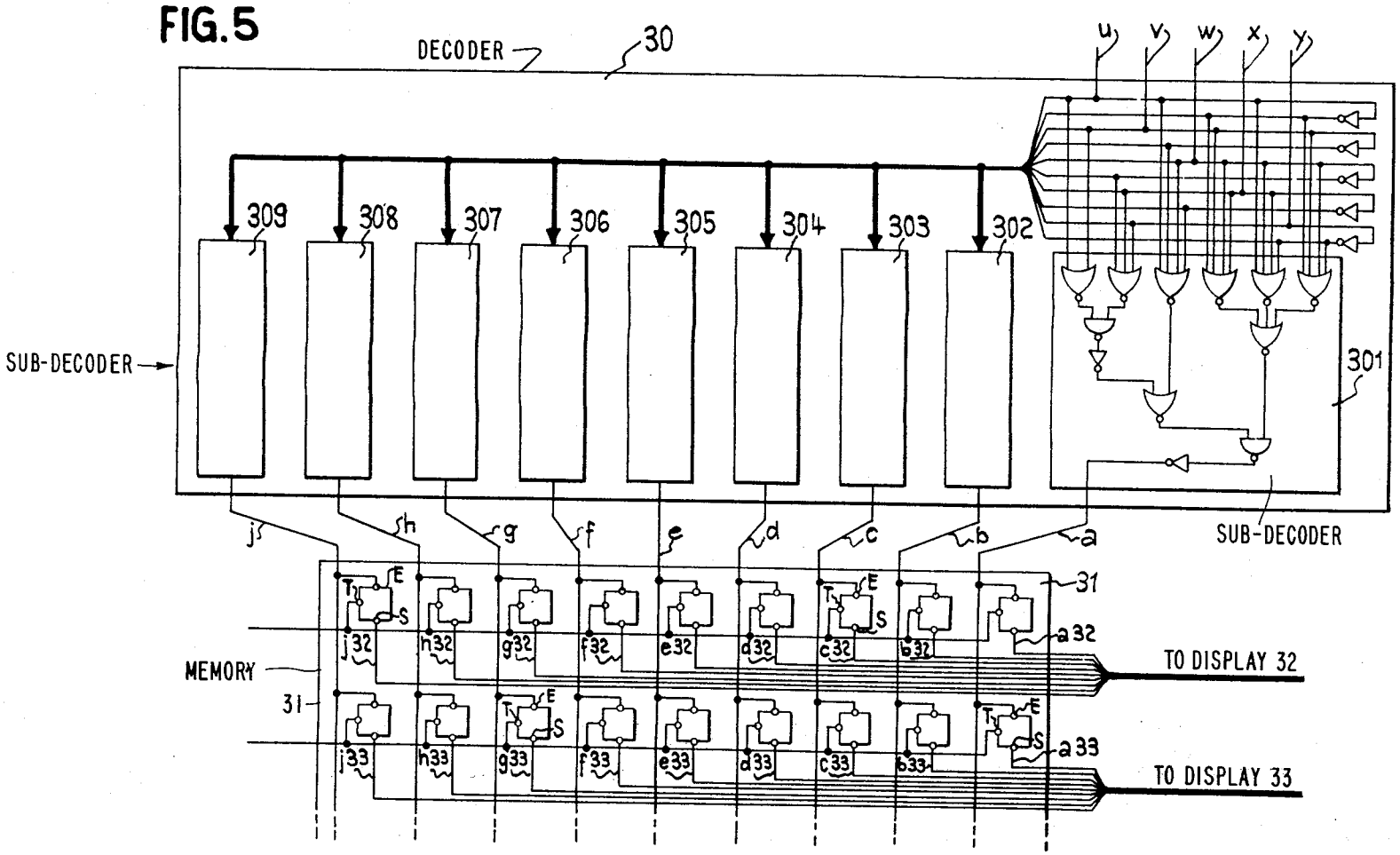

FIG. 5 shows the decoder which includes several sub-decoders 301 to 309, each of them being associated with a particular segment of the digit display. As has already been indicated, the five input lines of the decoder 30 present an order number in code (0 to 27, c.f. table I) corresponding to the symbol to be displayed. By way of example, we give below, with the aid of the formulae in Boolean algebra the possible constituents of the sub-decoders 301 to 309 one of which (301) has been shown in detail.

TABLE II

| counter | 12 | | | abreviation | | Sub-encoder 261 | | | | | | Sub-encoder 262 | | | | |
|---|---|---|---|---|---|---|---|---|---|---|---|---|---|---|---|---|
| | C | B | A | | | u | v | w | x | y | | u' | v' | w' | x' | y' |
| Monday | 0 | 0 | 0 | M0 | (M) | 0 | 1 | 1 | 1 | 0 | (0) | 1 | 0 | 1 | 1 | 1 |
| Tuesday | 0 | 0 | 1 | TU | (T) | 1 | 1 | 0 | 0 | 0 | (U) | 1 | 0 | 0 | 0 | 1 |
| Wednesday | 0 | 1 | 0 | WE | (W) | 1 | 1 | 0 | 0 | 1 | (E) | 0 | 1 | 1 | 0 | 1 |
| Thursday | 0 | 1 | 1 | TH | (T) | 1 | 1 | 0 | 0 | 0 | (H) | 1 | 1 | 0 | 1 | 0 |
| Friday | 1 | 0 | 0 | FR | (F) | 0 | 1 | 1 | 0 | 0 | (R) | 1 | 1 | 0 | 1 | 1 |
| Saturday | 1 | 0 | 1 | SA | (S) | 1 | 0 | 0 | 1 | 1 | (A) | 0 | 1 | 0 | 1 | 1 |
| Sunday | 1 | 1 | 0 | SU | (S) | 1 | 0 | 0 | 1 | 1 | (U) | 1 | 0 | 0 | 0 | 1 |

For the months, the principle is the same.

TABLE III

| | | | | | |
|---|---|---|---|---|---|
| January | : | JA | July | : | JL |
| February | : | FE | August | : | AU |
| March | : | MA | September | : | SE |
| April | : | AP | October | : | OC |
| May | : | MY | November | : | NO |
| June | : | JU | December | : | DE |

$$\bar{a} = \bar{u}\,v\,\bar{w}\,x\,y + u\,\bar{v}\,w\,\bar{x} + \bar{u}\,v\,w\,\bar{x} + \bar{u}\,w\,x\,\bar{y} + \bar{u}\,v\,w\,\bar{y} \text{ (illustrated)}$$
$$\bar{b} = \bar{v}\,w\,x + u\,\bar{v}\,w\,\bar{x}\,\bar{y} + u\,\bar{v}\,w\,\bar{y} + \bar{u}\,\bar{v}\,w\,y + \bar{u}\,\bar{v}\,x\,y + v\,\bar{w}\,\bar{x}\,y$$
$$\bar{c} = \bar{v}\,w\,x + u\,w\,x + \bar{u}\,v\,\bar{w}\,\bar{x} + \bar{u}\,\bar{v}\,y + u\,v\,x\,y$$
$$\bar{d} = \bar{u}\,\bar{v}\,w\,\bar{y} + u\,v\,w\,\bar{y} + u\,\bar{v}\,\bar{w}\,\bar{x}\,\bar{y} + u\,v\,x + \bar{u}\,\bar{v}\,\bar{w}\,y + \bar{u}\,x\,y + u\,\bar{v}\,w\,y + \bar{u}\,w\,x$$
$$e = v\,\bar{w}\,x\,y + u\,\bar{v}\,w\,\bar{x}\,y + \bar{u}\,x\,y + \bar{u}\,v\,w\,y + \bar{u}\,\bar{v}\,w\,x + u\,v\,w\,\bar{x} + u\,\bar{v}\,\bar{w}\,\bar{y}$$
$$f = u\,\bar{v}\,w\,y + \bar{u}\,\bar{v}\,x\,y + \bar{u}\,w\,x\,y + u\,v\,\bar{x}\,\bar{y} + u\,\bar{v}\,\bar{w}\,\bar{y}$$
$$g = v\,w\,x\,y + u\,\bar{v}\,\bar{x}\,\bar{y} + \bar{u}\,v\,\bar{w}\,x + v\,\bar{x}\,\bar{y} + \bar{w}\,\bar{y} + u\,\bar{v}\,x\,\bar{y} + \bar{u}\,v\,\bar{y}$$
$$h = \bar{u}\,v\,w\,x + \bar{u}\,\bar{v}\,x\,y + \bar{u}\,v\,w\,y$$
$$j = \bar{u}\,\bar{v}\,\bar{w}\,y + \bar{u}\,v\,w\,y + u\,x\,y$$

In FIG. 5 part of the memory device 31 is shown which is composed of a matrix of memories each row of which is provided for a digit of the display. Each memory is provided with an input E to which is connected one of the outputs *a* to *j* of the decoder 30, and a control input T to which is connected one of the outputs of the register 24. The information present at the input at the moment when an impulse arrives on the input T, passes to the output S and remains there at least until the arrival of the following control impulse on input T. One output line of the register 24 provides a control impulse to each of the memories of a horizontal row whilst the information of one of outputs *a, b, c, d, e, f, g, h* or *j* is supplied to the inputs E of each of the memories in a vertical row.

In operation, the register 24 first enables the transmission gates 14 and 220. Assuming that the user has chosen with the aid of the function selector 29 the information "day, date and month," the information I120 of the counter-divider 12 is supplied via the encoder (or sub-encoder) selected on the selector 38 to decoder 30 to be decoded. At the same time, the impulse of the register 24 operates, in the memory device 31, the memories of the first row, the outputs *a*32, *b*32, *c*32, . . . etc of which go to drive the segments of the first digit 32. The next impulse of the register 24 with its second output gates the information I121 which is, in fact, the same as the preceding information I120 supplied via another sub-encoder of the previously selected encoder to the decoder and memory and will go on the outlets *a*33, *b*33, *c*33 etc. . . . , of the memories of the second row, enabled by the second output of the register 24, to drive the segments of the second digit 33. A similar process occurs for the information contained in the counter-dividers 10 and 11 and the counter 13 (I130 and I131).

It is to be remembered that the digits 34 and 35 of the display will only have to indicate numbers, and they thus require only seven segments instead of nine, which reduces notably the number of individual memories required in the memory 31.

The watch in accordance with the invention thus presents the advantage of only necessitating for its manufacture, a single integrated circuit with which the manufacturer can by simple soldering on one of the control terminals P of an encoder, choose the language in which the abbreviation the names of the days and of the months will appear.

Also an external switch could be provided which permits the user to select this language.

It is clear that the watch could if desired only comprise a single counter adapted to display the name of the days for example.

We claim:

1. An electronic watch having an alpha-numeric display comprising, in addition to counter-dividers adapted to indicate seconds, minutes, hours and date, at least one counter adapted to provide a display in the form of letters of the alphabet, and several encoding means, associated with the said at least one counter, each of the encoding means, being adapted to a particular language and being selectively actuatable by means of a control terminal.

2. A watch in accordance with claim 1, wherein the encoding means are associated with a counter adapted to display the days of the week.

3. A watch in accordance with claim 1, wherein the encoding means are associated with counters adapted to display the days of the week and the months of the year.

4. A watch in accordance with claim 1, wherein the control terminal of the selected encoding means is connected by soldering to a predetermined potential.

5. A watch in accordance with claim 1, wherein an external switch is provided by means of which a user can select the encoding means of his choice.

* * * * *